US012601572B2

(12) United States Patent
Austin, II et al.

(10) Patent No.: US 12,601,572 B2
(45) Date of Patent: Apr. 14, 2026

(54) PERFORATING JET SHAPING SYSTEMS AND METHODS

(71) Applicant: Schlumberger Technology Corporation, Sugar Land, TX (US)

(72) Inventors: David Austin, II, Rosharon, TX (US); John Fuller, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/442,814

(22) Filed: Feb. 15, 2024

(65) Prior Publication Data

US 2025/0264310 A1 Aug. 21, 2025

(51) Int. Cl.
*F42B 1/028* (2006.01)
*F42D 1/02* (2006.01)
*E21B 43/117* (2006.01)

(52) U.S. Cl.
CPC ..... *F42B 1/028* (2013.01); *F42D 1/02* (2013.01); *E21B 43/117* (2013.01)

(58) Field of Classification Search
CPC ..... E21B 43/116–117; F42B 1/00–036; F42D 1/02
USPC ..... 89/1.151; 102/305–310
See application file for complete search history.

(56) References Cited

U.S. PATENT DOCUMENTS 2,601,714 A 7/1952 Connally
2,837,995 A * 6/1958 Castel ..... F42B 3/08 175/4.6
3,224,368 A 12/1965 House
3,251,300 A * 5/1966 Reyne ..... E21B 43/117 102/310
3,732,818 A * 5/1973 Thomanek ..... F42B 1/024 102/306
4,041,866 A 8/1977 Thevenin
4,487,130 A * 12/1984 Brattstrom ..... F42B 1/02 102/476
4,498,367 A 2/1985 Skolnick
4,499,830 A 2/1985 Majerus
(Continued)

FOREIGN PATENT DOCUMENTS

DE 2927556 C1 5/1985
DE 19630339 A1 1/1997
(Continued)

OTHER PUBLICATIONS

Kleiser, G. et al.; "Control of Shaped Charge Jets Through Nppon-uniform Confinement"; The 13th Hypervelocity Impact Symposium, Boulder Colorado, USA, Apr. 26-30, 2015; pp. 302-309.
(Continued)

*Primary Examiner* — Troy Chambers
*Assistant Examiner* — Benjamin S Gomberg
(74) *Attorney, Agent, or Firm* — Kyle R. Miiller

(57) ABSTRACT

The present disclosure relates to a shaped charge. The shaped charge includes an explosive component and a liner member coupled to the explosive component. The explosive component and the liner member emit a perforating jet based on ignition of the explosive component. The liner member has a planar symmetric portion that is planar symmetric along an axial length of the planar symmetric portion relative to planes perpendicular to a direction of the emitted perforating jet.

20 Claims, 14 Drawing Sheets

(56) References Cited

U.S. PATENT DOCUMENTS

| | | | | |
|---|---|---|---|---|
| 4,798,145 | A * | 1/1989 | McVeagh | F42B 1/036 102/306 |
| 4,807,795 | A | 2/1989 | LaRocca | |
| 5,175,391 | A | 12/1992 | Walters | |
| 5,251,530 | A * | 10/1993 | Kaeser | F42B 1/036 86/20.14 |
| 5,616,885 | A * | 4/1997 | Walters | F42B 1/02 102/306 |
| 6,021,714 | A | 2/2000 | Grove | |
| 6,840,178 | B2 * | 1/2005 | Collins | F42B 1/028 102/307 |
| 7,600,476 | B1 * | 10/2009 | Baker | F42B 1/02 102/306 |
| 7,712,416 | B2 | 5/2010 | Pratt | |
| 7,987,911 | B2 | 8/2011 | Rhodes | |
| 9,612,094 | B1 | 4/2017 | Collier | |
| 10,520,286 | B2 * | 12/2019 | Loehken | F42B 1/028 |
| 11,053,782 | B2 | 7/2021 | Loehken | |
| 11,215,039 | B2 | 1/2022 | Hinton | |
| 2005/0011395 | A1 * | 1/2005 | Langan | F42B 1/032 102/476 |
| 2005/0115448 | A1 | 6/2005 | Pratt | |
| 2007/0214991 | A1 | 9/2007 | Ronn | |
| 2008/0047458 | A1 | 2/2008 | Storm | |
| 2008/0289529 | A1 | 11/2008 | Schilling | |
| 2009/0050321 | A1 | 2/2009 | Rhodes | |
| 2011/0155013 | A1 | 6/2011 | Boyer | |
| 2011/0219978 | A1 | 9/2011 | Glenn | |
| 2011/0239888 | A1 | 10/2011 | Waddell | |
| 2012/0247358 | A1 | 10/2012 | Daoud | |
| 2013/0056208 | A1 | 3/2013 | Xu | |
| 2013/0104765 | A1 | 5/2013 | Stecher | |
| 2014/0076132 | A1 | 3/2014 | Bird | |
| 2014/0310940 | A1 | 10/2014 | Grattan | |
| 2015/0316360 | A1 * | 11/2015 | Hinton | F42B 1/028 102/307 |
| 2016/0153267 | A1 * | 6/2016 | Walker | E21B 43/114 166/55 |
| 2016/0209187 | A1 | 7/2016 | Stecher | |
| 2018/0030334 | A1 * | 2/2018 | Collier | E21B 43/26 |
| 2019/0309606 | A1 * | 10/2019 | Loehken | E21B 43/117 |
| 2023/0131652 | A1 * | 4/2023 | Loehken | F42B 1/02 102/307 |
| 2025/0237122 | A1 * | 7/2025 | MacGillivray | E21B 43/117 |
| 2025/0264308 | A1 | 8/2025 | Austin, II | |
| 2025/0264309 | A1 | 8/2025 | Austin, II | |
| 2025/0271243 | A1 * | 8/2025 | MacGillivray | F42B 1/02 |

FOREIGN PATENT DOCUMENTS

| | | |
|---|---|---|
| GB | 2303687 A | 2/1997 |
| GB | 2333825 A | 8/1999 |
| RU | 2358094 C2 | 6/2009 |

OTHER PUBLICATIONS

Miller, S. et al., "The Role of Rayleigh Taylor Instability in Shaped Charge Jets Formation and Stability", 22nd International Symposium on Ballistics, Vancouver, BC, Canada, Nov. 14-18, 2005, 10 pages.

Tan, G. E. B. et al., "Planar Cutting Jets From Shaped Charges,", 22nd International Symposium on Ballistics, Vancouver BC, Canada, Nov. 14-18, 2005, 9 pages.

Walters, W. P. et al., "Fundamentals of Shaped Charges", CMC Press, Baltimore MD, 1989, pp. 1-10, 72-100, 171-265.

Office Action issued in U.S. Appl. No. 18/442,552, dated Mar. 10, 2025, 12 pages.

Office Action issued in U.S. Appl. No. 18/442,701 dated Apr. 18, 2025, 9 pages.

* cited by examiner

PERFORATING JET SHAPING SYSTEMS AND METHODS

BACKGROUND

The present disclosure generally relates to systems and methods for shaping perforating jets.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admission of prior art.

Exploring, drilling, and completing hydrocarbon and other wells are generally complicated, time consuming and ultimately very expensive endeavors. As a result, over the years, well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and architecture may increase the likelihood of accessing underground hydrocarbon reservoirs, other challenges are presented in terms of well management and the maximization of hydrocarbon recovery from such wells. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Indeed, a variety of isolating, perforating, and stimulating applications may be employed in conjunction with completions operations.

In the case of perforating, different zones of the well may be outfitted with packers and other hardware, in part for sake of zonal isolation. Thus, wireline or other conveyance may be directed to a given zone and a perforating gun employed to create perforation tunnels through the well casing. Specifically, shaped charges housed within a steel gun may be detonated to form perforations or tunnels into the surrounding formation, ultimately enhancing recovery therefrom.

The profile, depth, and other characteristics of the perforations are dependent upon a variety of factors in addition to the material structure through which each perforation penetrates. That is, the jet formed by the detonation of a given shaped charge may pierce a steel casing, cement, and a variety of different types of rock that make up the surrounding formation. However, characteristics of different components of the shaped charge itself may determine the characteristics of the jet, and ultimately the depth, profile, and overall effectiveness of each given perforation as described herein.

Among other components, a shaped charge generally includes a case, explosive pellet material, and a liner member. Thus, detonation of the explosive within the case may be utilized to direct the liner away from the gun and toward the well wall as a means by which to form the noted jet. Therefore, the characteristics of the jet are largely dependent upon the behavior of the liner and other shaped charge components upon detonation. For example, a solid copper or zinc liner may be utilized to generate a jet of considerable stretch with a head or tip that travels at 5-10 times the rate of speed as compared to the speed at the tail. Depending on the casing thickness, formation type, and other such well-dependent characteristics, this type of liner is generally of notable effectiveness in terms of achieving substantial depth of penetration.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, the present disclosure is directed to a shaped charge. The shaped charge includes an explosive component and a liner member coupled to the explosive component. The explosive component and the liner member emit a perforating jet based on ignition of the explosive component. The liner member has a planar symmetric portion that is planar symmetric along an axial length of the planar symmetric portion relative to planes perpendicular to a direction of the emitted perforating jet.

In one embodiment, the present disclosure is directed to a shaped charge. The shaped charge includes an explosive component. The shaped charge also includes a liner member coupled to the explosive component. The explosive component and the liner member are configured to emit a perforating jet based on ignition of the explosive component. Further, the shaped charge includes an external confinement feature that imparts a planar symmetry to the shaped charge.

In one embodiment, the present disclosure is directed to a method. The method includes providing a shaped charge. The method also includes inducing a planar symmetry in or near a liner member associated with the shaped charge. Further, the method includes assembling the shaped charge having the planar symmetry.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
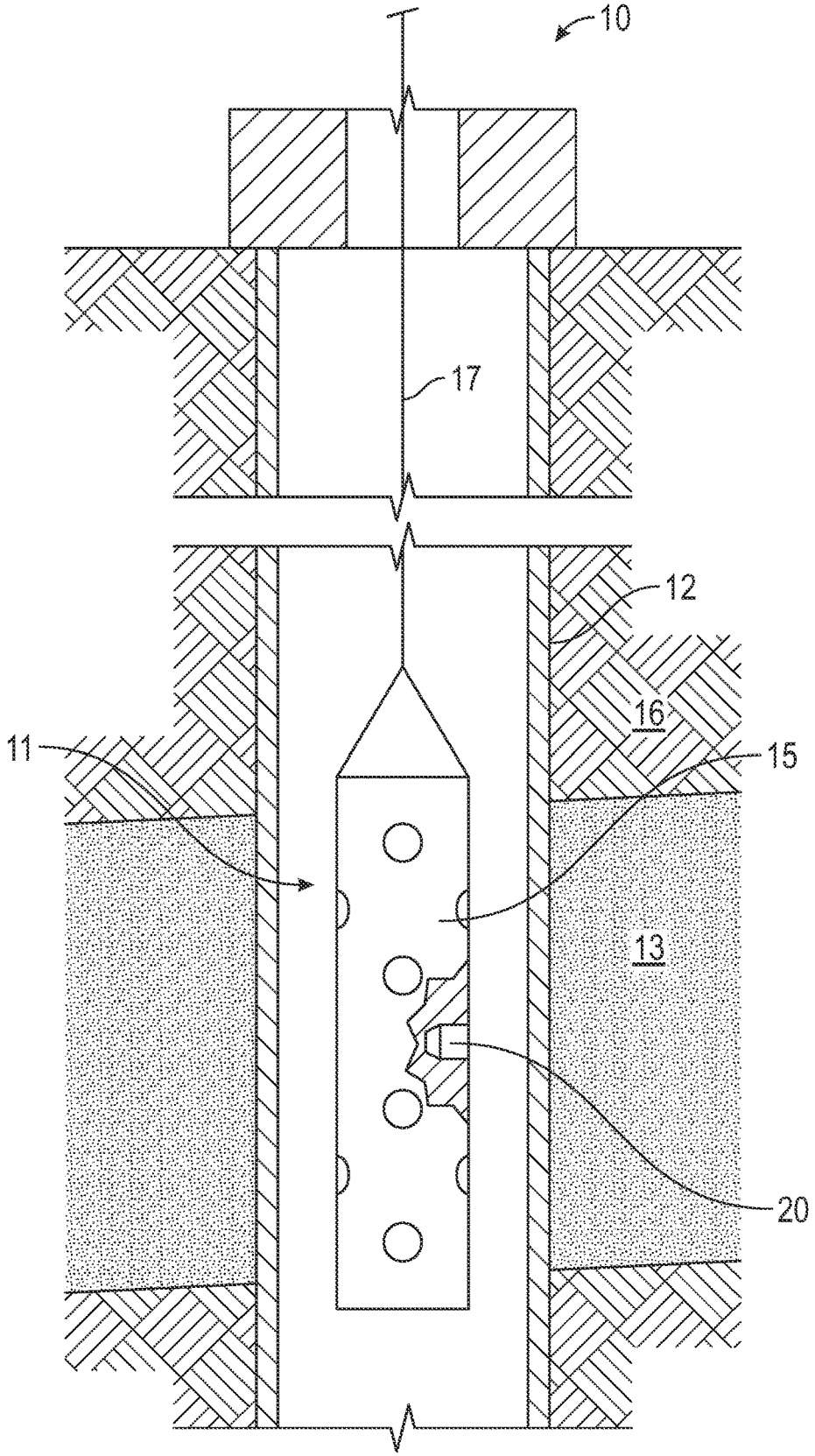
FIG. 1 shows a perforation operation, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As discussed above, shaped charges are used for a variety of oil and gas applications. In particular, the jet formed by the detonation of a given shaped charge may pierce a steel casing, cement, and a variety of different types of rock that make up the surrounding formation. The characteristics of the jet produced by a shaped charge are largely dependent upon the behavior of the liner and other shaped charge components upon detonation.

At least in some instances, it may be desirable to sever a control line behind a completion prior to cementing as part of a plug and abandon operation. To do so, it is advantageous to sever the intended target control line while minimizing unexpected damage to other parts of the completion. Conventional explosive intervention options, such as explosive intervention options include axisymmetric shaped charges, short linear slot cutters, and radially symmetric circumferential cutters, are used to accomplish a task. However, each of these options has one or more shortcomings from irregular or unexpected performance, expensive or difficult manufacturing, or deployment.

It is presently recognized that altering the mass distributions of an explosive component, liner member, or both of an axisymmetric shaped charge design, may convert a shaped charge to an alternate symmetry that provides a fan-like cutting jet. For cutting control lines, it may be advantageous to adjust the mass distributions such that the resulting shaped charge has a planar symmetry, whereby mass is added or removed at poles 180 degrees apart. As a result, during jet collapse, the normally axially uniform fast-moving perforating jet is a slower fan-like geometry. The perforating jet having the fan-like geometry may act over a line spanning multiples degrees from the axis of symmetry (e.g., perpendicular to a perforating jet direction), thereby providing increased coverage as a cutter while still achieving velocities and densities inside the cutting fan. The perforating jet may perform comparable to linear slot cutters, but can also be retrofitted into existing hardware and manufacturing methods.

Accordingly, the present disclosure relates to a planar symmetric liner member that forms a fan-line cutting jet when shot from an axisymmetric charge body, which may be advantageous for certain cutting or perforating jet applications (e.g., cutting or severing control lines). In general, the planar symmetric liner member includes two or more metal powders or metal powder mixtures, which may provide a region having a high average green density and a region having a low average green density (e.g., after pressing). In some embodiments, the planar symmetric liner member may include additional materials other than metal powders, such as machined metal parts, injection molded plastic parts, ceramic parts, powders, or a combination thereof. In such embodiments, the additional materials may become incorporated (e.g., via a compaction process) with the metal powders into a single piece liner. In some embodiments, the planar symmetric liner member may include features that are planar symmetric (e.g., the original liner member may not be planar symmetric but additional liner features include planar symmetry). For example, while the planar symmetric liner member in its entirety may be axisymmetric, the planar symmetric liner member may have additional volume at the apex, skirt, or other region(s) that are planar symmetric, doubly planar symmetric, or symmetric on another period and which intrude into the region either towards or away from the central axis. The disclosed planar symmetric liner member may be produced or otherwise manufactured using existing powder metal pressing methods to produce a single piece liner. The single piece liner may be pressed into otherwise conventionally manufactured charges requiring fewer parts and manufacturing operations with the result being a deep planar cutter for use against behind casing control lines. In this way, the planar symmetric liner member may be capable of producing a desired perforating jet that is otherwise unable to be produced using conventional shaped charges, while also capable of being manufactured using existing, less expensive techniques.

With reference to FIG. 1, after a well 10 is drilled, a casing 12 is typically run in the well 10 and cemented to the well 10 in order to maintain well integrity. After the casing 12 has been cemented in the well 10, one or more sections of the casing 12 that are adjacent to the formation zones of interest (e.g., target well zone 13) may be perforated to allow fluid from the formation zones to flow into the well for production to the surface or to allow injection fluids to be applied into the formation zones. To perforate a casing section, a perforating gun string may be lowered into the well 10 to a desired depth (e.g., at target zone 13), and one or more perforation guns 15 may be fired to create openings in the casing 12 and to extend perforations into the surrounding formation 16. Production fluids in the perforated formation 16 can then flow through the perforations and the casing openings into the wellbore 11.

Typically, perforating guns 15 (which include gun carriers and shaped charges mounted on or in the gun carriers or, alternatively, include sealed capsule charges) are lowered through tubing or other pipes to the desired formation interval on a line 17 (e.g., wireline, e-line, slickline, coiled tubing, and so forth). The charges carried in a perforating gun 15 may be phased to fire in multiple directions around the circumference of the wellbore 11. Alternatively, the charges may be aligned in a straight line. When fired, the charges create perforating jets that form holes in the surrounding casing 12 as well as extend perforation tunnels into the surrounding formation 16.

With reference to FIG. 1, certain embodiments of the present disclosure include a perforation system comprising: (1) a perforating gun 15 (or gun string), wherein each gun may be a carrier gun (as shown) or a capsule gun (not shown); and (2) one or more improved shaped charges 20 loaded into the perforating gun 15 (or into each gun of the gun string), each charge having a liner member, as described herein; and (3) a conveyance mechanism 17 for deploying the perforating gun 15 (or gun string) into a wellbore 11 to align at least one of said shaped charges 20 within a target formation interval 13, wherein the conveyance mechanism may be a wireline, tubing, or other conventional perforating deployment structure; among other components.

Examples of explosives (e.g., explosive component as described in FIG. 4) that may be used in the various explosive components (e.g., charges, detonating cord, and boosters) include RDX (cyclotrimethylenetrinitramine or hexahydro-1,3,5-trinitro-1,3,5-triazine), HMX (cyclotetramethylenetetranitramine or 1,3,5,7-tetranitro-1,3,5,7-tetraazacyclooctane), TATB (triaminotrinitrobenzene), HNS (hexanitrostilbene), and others.

Figure 2:
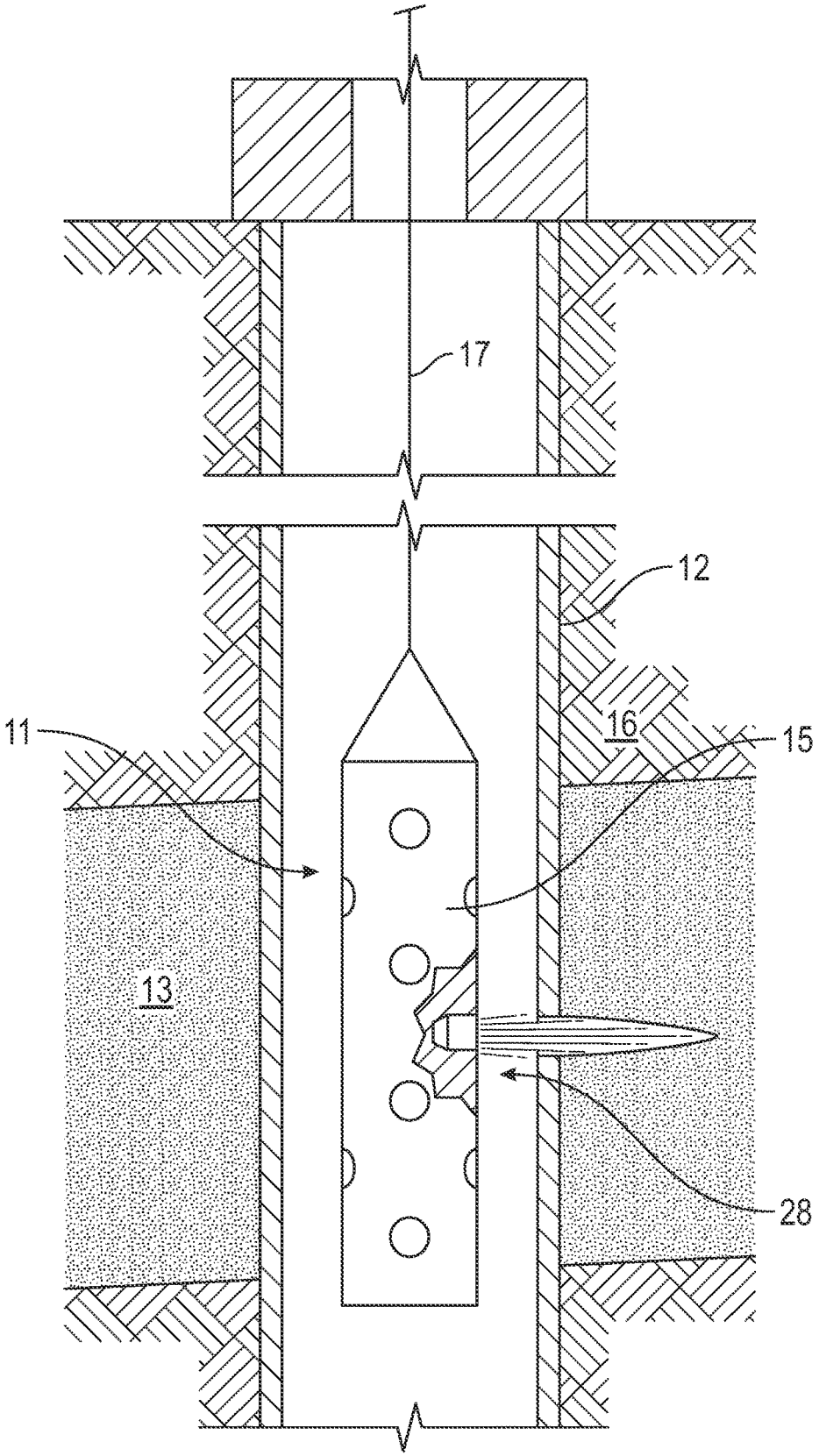
FIG. 2 shows a diagram illustrating a perforation being made with a perforation gun, in accordance with aspects of the present disclosure.
Figure 3:
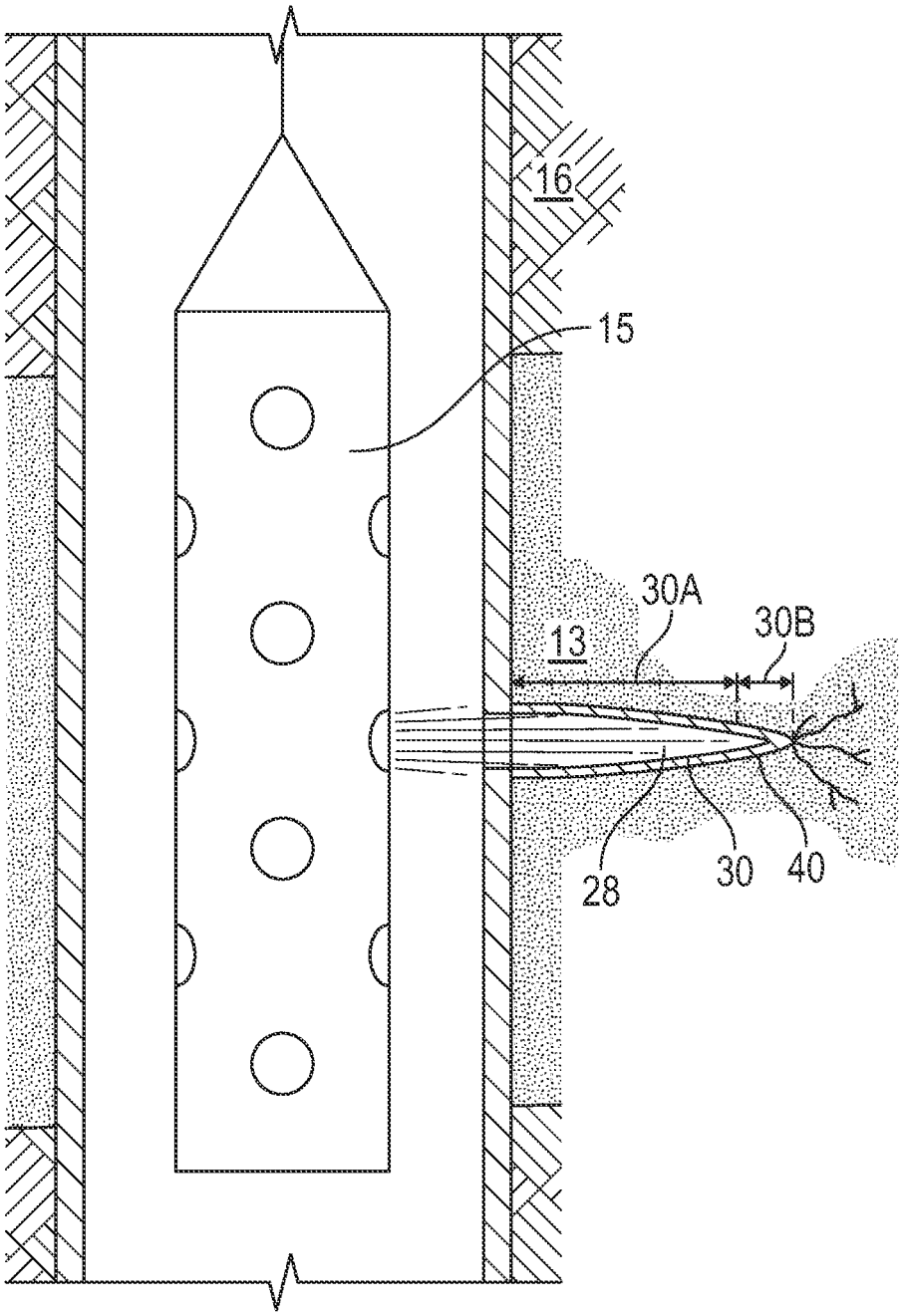
FIG. 3 shows a diagram illustrating a perforation and a tunnel made with a shaped charge, in accordance with aspects of the present disclosure.

Referring to FIGS. 2 and 3, the material from a collapsed liner of the shaped charge 20 (e.g., as described in more detail in FIG. 4) forms a perforating jet 28 that shoots through the front of the shaped charge and penetrates the casing 12 and underlying formation 16 to form a perforated tunnel (or perforation tunnel) 40. Around the surface region adjacent to the perforated tunnel 40, a layer of residue 30 from the charge liner is deposited. The charge liner residue 30 includes "wall" residue 30A deposited on the wall of the perforating tunnel 40 and "tip" residue 30B deposited at the tip of the perforating tunnel 40. As described in more detail with respect to FIG. 5, adjusting properties of the shaped charge 20 (e.g., the geometry of the liner, the density of the liner, the mechanical strength of the liner, and so on) may adjust jet properties (e.g., jet velocity and/or jet shape) of the perforating jet 28.

Figure 4:
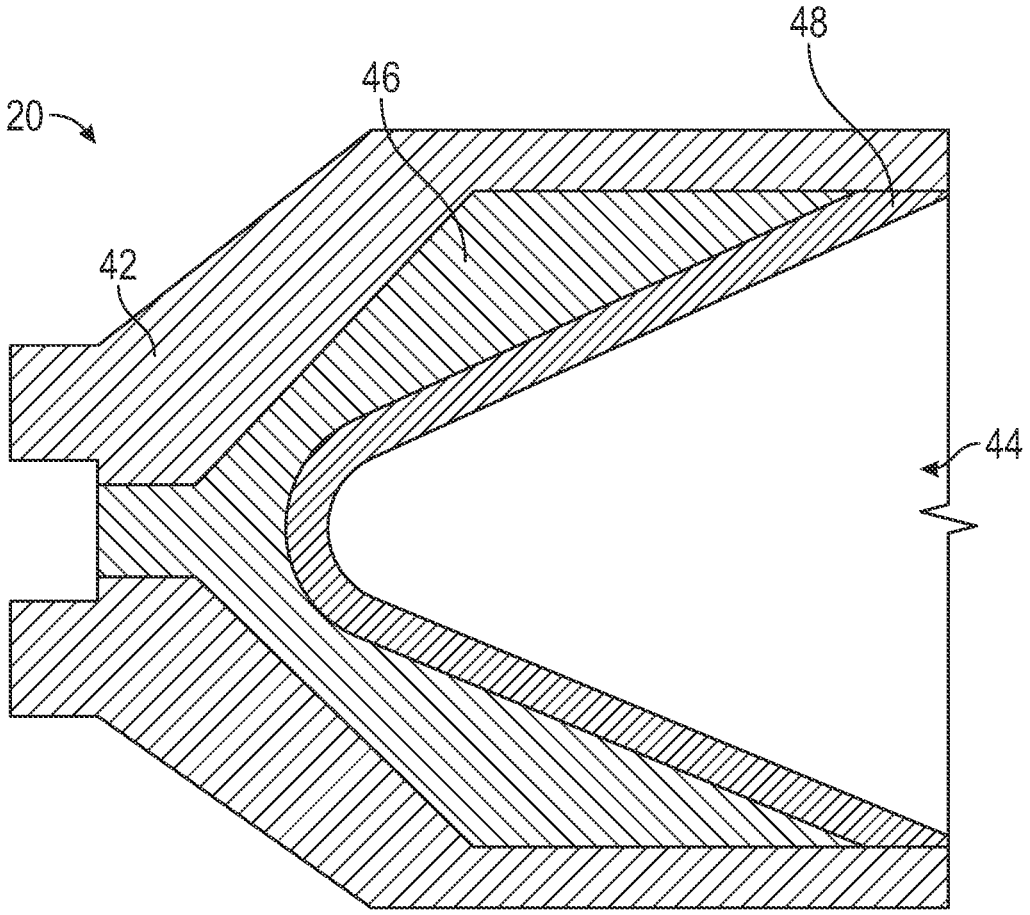
FIG. 4 shows a cross-sectional view of an embodiment of a shaped charge, in accordance with aspects of the present disclosure.

Referring now to FIG. 4, a cross sectional view of an embodiment of a shaped charge 20 is shown. The shaped charge 20 includes a casing member 42 and an interior volume 44 that is defined by an explosive component 46 and a liner member 48. The explosive component 46 is disposed between the casing member 42 and the liner member 48 such that the liner member 48 surrounds the interior volume 44.

The liner member 48 may be formed of packed, powdered metals and, in at least in some instances, non-metallic materials. The metals of the liner member 48 may include metals having a density of approximately 6 or greater grams per cubic centimeter (g/cc), 7 or greater g/cc, 8 or greater g/cc, 9 or greater g/cc, 10 or greater g/cc, 11 or greater g/cc, 12 or greater g/cc, or 13 or greater g/cc, and so on. In some embodiments, the metals of the liner member 48 may include metals having a density less than approximately 6 g/cc (e.g., aluminum, beryllium, titanium, and so on). For example, the liner member 48 may include copper (e.g., having a density of approximately 8.9 g/cc) and/or lead (e.g., having a density of approximately 11.3 g/cc). In some embodiments, the liner member 48 may include tungsten (e.g., having a density of approximately 19.3 g/cc). In some embodiments, the liner member 48 may include a mixture of metals, which may provide a desired density. For example, the liner member 48 may include approximately 50 weight percent (wt %) or greater, approximately 60 wt % or greater, approximately 70 wt % or greater, approximately 80 wt % or greater, or approximately 90 wt % or greater of a first metal (e.g., tungsten). Further, the liner member 48 may include a remaining wt % of a second metal (e.g., copper or lead), such as approximately 10 wt % or less, 20 wt % or less, 30 wt % or less, and so on.

As mentioned above, the liner member 48 may also include non-metallic materials, such as nitrides, carbides, oxides, diamond, ceramic materials, or a combination thereof. For example, the liner member 48 may include relatively low-density materials (e.g., as compared to the metals), such as SiC, $Si_3N_4$, $SiO_2$, $B_4C$, $B_4N$, ZnO, TiC, $Li_3N$, $TiO_2$, $Mg_3N_2$, and other relatively low density non-metallic materials. In some embodiments, the liner member 48 may include a polymer material, such as fluorinated polymers (e.g., polytetrafluoroethylene). In some embodiments, the liner member 48 may include metal-polymer composite mixtures. In such embodiments, the liner member 48 may include a first weight percent (wt %) (e.g., first amount) of one or more metals and a second wt % of one or more non-metallic materials. For example, the liner member 48 may include approximately 50 wt % or greater, 60 wt % or greater, 70 wt % or greater, 80 wt % or greater, 90 wt % or greater of one or more metals. As such, the liner member 48 may include approximately 50 wt % or less, 40 wt % or less, 30 wt % or less, 20 wt % or less, or 10 wt % or less of one or more non-metallic materials.

Figure 5A:
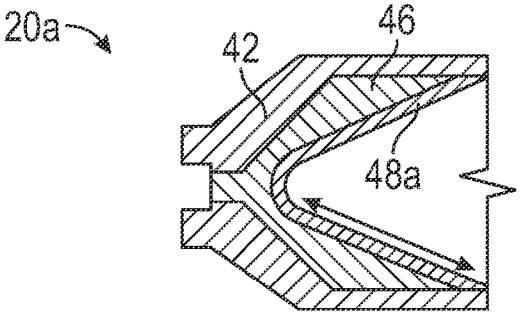
FIG. 5A shows a diagram of the shaped charge of FIG. 4 forming a first type of jet, in accordance with aspects of the present disclosure.
Figure 5B:
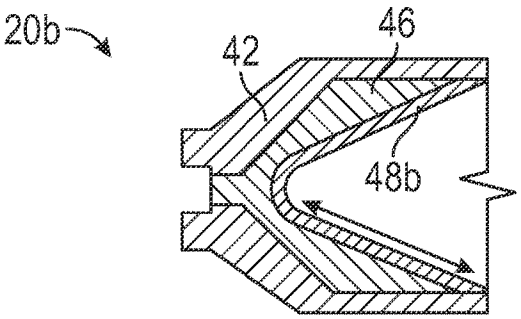
FIG. 5B shows a diagram of the shaped charge of FIG. 4 forming a second type of jet, in accordance with aspects of the present disclosure.
Figure 5C:
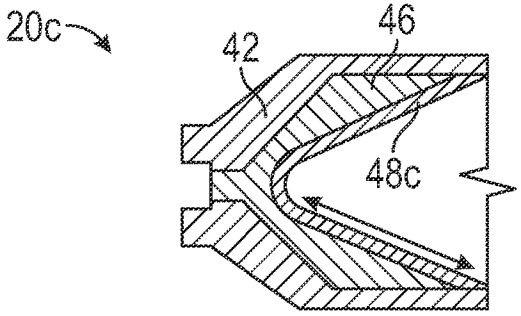
FIG. 5C shows a diagram of the shaped charge of FIG. 4 forming a third type of jet, in accordance with aspects of the present disclosure.

Referring specifically now to FIGS. 5A, 5B, and 5C (e.g., collectively FIGS. 5A-5C), side cross-sectional views of different types of shaped charges 20*a*, 20*b*, and 20*c* in use during perforating applications are shown. That is, in each case, a charge 20*a*, 20*b*, and 20*c* has been loaded into a perforating gun (not shown), and utilized in a perforating application in a well 10. The charges 20*a*, 20*b*, and 20*c* may be made up of generally the same features described with respect to FIG. 1. For example, the charges 20*a*, 20*b*, and 20*c* may include the same type of casing 12 and explosive component 46. However, in each case, a different type of liner member 48*a*, 48*b*, and 48*c* may be used to provide a different type of charge 20*a*, 20*b*, and 20*c* for a different type of perforating application.

With reference to FIG. 5A in particular, a deep penetrating jet shaped charge 20*a* is shown. Upon detonation, a deep penetrating jet 28*a* is formed and directed at the casing 12 that defines the well 10. Ultimately, this forms a perforation tunnel 40*a* that penetrates through the casing member 42, cement 49, and into the adjacent formation 16 so as to aid in hydrocarbon recovery therefrom. In the embodiment shown, the liner member 48*a* that is used to form the jet 28*a* and achieve such penetration may be a comparatively thin but high-density tungsten-based liner member 48*a* so as to form a thinner and longer jet 28*a*. The end result, depending largely on the particular characteristics of the casing 12, may be a perforation tunnel 40*a* of between approximately 30 and approximately 40 inches deep with a diameter of between approximately 0.3 inches and approximately 0.4 inches.

Of course, as depicted in the embodiment of FIG. 5B, a different type of liner member 48*b* may be utilized to obtain a different type of charge 20*b* and performance during perforation. More specifically, in the embodiment of FIG. 5B, a side cross-sectional view of wide jet shaped charge 20*b* is shown. In this case, the liner member 48*b* is of a comparatively thicker dimension and lower density, perhaps with a lower percentage of tungsten. Thus, a comparatively thicker or wider jet 28*b* may be formed. The end result, again depending on characteristics of the casing 12 and other physical factors, may be a shorter perforation tunnel 40*b* that is closer to a threshold distance (e.g., 60-90 cm deep but with a wider diameter (e.g. between about 1 cm and about 1.3 cm).

Referring now to FIG. 5C, a side cross-sectional view of a combination jet shaped charge 20*c* is shown. In this case, the liner member 48*c* may be of a thickness, density, materials and other characteristics similar to either of the deep penetrating 48*a* or wide 48*b* liner member types described above. However, the combination liner member 48*c* of FIG. 5C is of a uniquely tailored non-uniform morphology. Thus, a combination jet 28*c* may ultimately be formed such that the perforation tunnel 40*c* which is formed is also of a uniquely tailored morphology.

Accordingly, FIGS. 5A-5C show that altering physical properties (e.g., density) of the liner member 48 adjusts the shape of the resulting jet 28. That is, by altering the explosive component 46, the liner member 48, and/or mass distributions of an axisymmetric shaped charge design, the charge may be converted to an alternate symmetry. It is presently recognized that for cutting control lines, it may be advantageous to use a shaped charge having a planar symmetry, whereby mass is added or removed at poles 180 degrees apart. As a result, during jet collapse, the normally axially uniform fast-moving jet is converted to a slower fan-like geometry that cuts the line spanning multiple degrees from the axis of symmetry serves to provide increased coverage of the cutter while still achieving velocities and densities inside the cutting fan, which are comparable to linear slot cutters, but which can utilize existing hardware and manufacturing methods.

As described herein, it is presently recognized that it may be advantageous to form a liner member 48 that has a planar symmetry (e.g., a planar symmetry liner member). As referred to herein, an object having an "axial symmetry" refers to an object that is symmetrical about a principle longitudinal axis (e.g., the axis described herein). As referred to herein, a "longitudinal axis" refers to an axis whereby an object is identical through one or more rotations around the object (e.g., one or more 45° rotations, one or more 60° rotations, one or more 90° rotations, or one or more 180° rotations). In addition, as referred to herein , a "principle longitudinal axis" refers to an axis having the highest number of rotations around the object while still appearing identical. For example, a cone may undergo an infinite number of rotations if rotated about the central longitudinal axis along its height. As referred to herein, an object having a "planar symmetry" refers to an object that is symmetrical at all planes perpendicular to the principle longitudinal axis at all points of intersection of the object along the principle longitudinal axis.

The disclosed planar symmetric liner member 48 may provide a jet having a fan-like geometry. Such a jet may span multiple degrees from the axis of symmetry (e.g., of the shaped charge), thereby providing increased coverage as a cutter while still achieving velocities and densities inside the cutting fan, which are comparable to linear slot cutters. In some embodiments, the planar symmetric liner member 48 may be formed by adjusting the mass distributions of the liner member 48 and/or explosive component 46.

Figure 6:
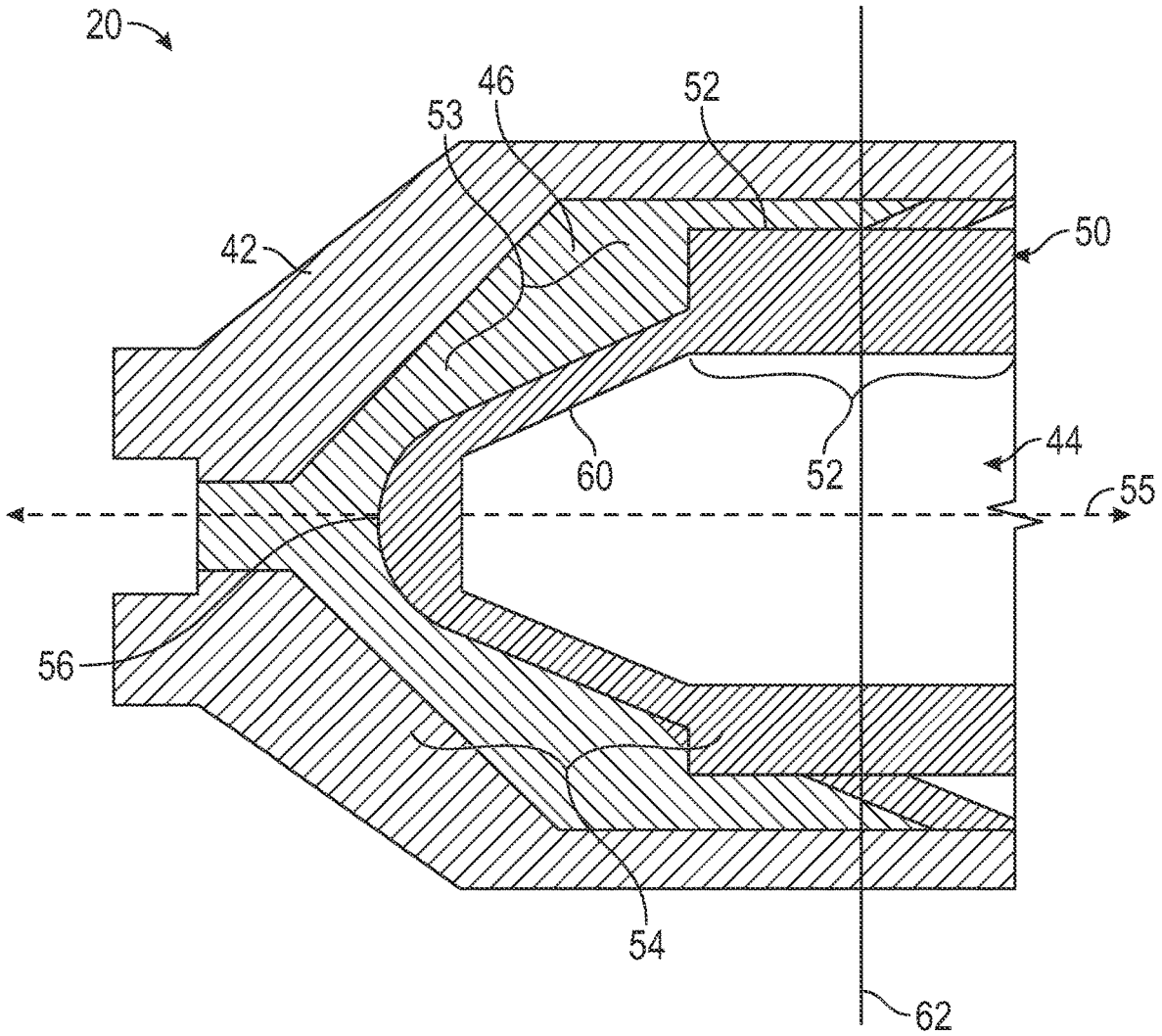
FIG. 6 shows a cross-sectional view of an embodiment of a shaped charge that includes a planar symmetry charge liner, in accordance with aspects of the present disclosure.

As shown in FIG. 6, the planar symmetry charge liner 50 includes a planar symmetric portion 52 and an axial symmetric portion 54. illustrated, the axial symmetric portion 54 includes a skirt section 53 that extends toward the planar symmetric portion 52 from an apex 56 of the axial symmetric portion 54 along a longitudinal axis 55, and the planar symmetric portion 52 has a generally cylindrical shape (e.g., located at an axial end of the skirt section 53, for example, away from the apex 56). The apex 56 and the skirt section 53, and the planar symmetric portion 52, generally define the interior volume 44 (e.g., inner volume) of the planar symmetry charge liner 50 as described herein.

In some embodiments, the planar symmetric portion 52 includes a mixture of metals and non-metallic materials. For example, the planar symmetric portion 52 may be a green compact formed of a powder including one or more metals and one or more non-metallic materials. Additionally or alternatively, the planar symmetric portion 52 may include a mixture of metals and non-metallic materials. In some embodiments, the planar symmetric portion 52 may be formed of relatively denser materials than the axial symmetric portion 54. In some embodiments, the planar symmetric portion 52 may be formed using machined metal parts, injected molded plastic parts, ceramic parts, metallic or non-metallic powders, or a combination thereof. However, in some embodiments, the planar symmetric portion 52 and the axial symmetric portion 54 may be formed of the same material.

As illustrated, the planar symmetric portion 52 is in contact with the axial symmetric portion 54. In particular, the planar symmetric portion 52 and the axial symmetric portion 54 form an outer surface 60 that extends from the apex 56 of the axial symmetric portion 54 to an axial end of the planar symmetric portion 52. The planar symmetric portion 52 is generally symmetric about the axis 55. That is, the planar symmetric portion 52 is symmetric through one or more rotations about the axis 55. Further, as described herein, the planar symmetric portion 52 includes a planar symmetry. For example, cross sections of the planar symmetric portion 52 are substantially identical at all planes 62 (e.g., mirror planes, horizontal mirror planes) that are perpendicular to the axis 55 along a length of the planar symmetric portion 52. However, the axial symmetric portion 54 does not include the same planar symmetry properties as the planar symmetric portion 52 (i.e., cross sections of the axial symmetric portion 54 are not substantially identical at all planes perpendicular to the axis along a length of the axial symmetric portion 54).

As discussed herein, utilizing a planar symmetry charge liner 50 (e.g., by adjusting the distribution of mass of the explosive component 46) may produce fan-like cutting jet. It is presently recognized that a "fan-like cutting jet" may be useful for selectively cutting certain downhole components (i.e., a control line), while avoiding other components. In some embodiments, the planar symmetry of the shaped charge 20 may be achieved by adding a confinement feature that is external to the liner member 48 and the explosive component 46, or the planar symmetry charge liner 50. Examples of such a confinement feature are generally described with reference to FIGS. 7A, 7B, 8A, 8B, 9A, 9B, 10A, 10B, 11A, and 11B (e.g., collectively FIGS. 7-11).

Figure 7A:
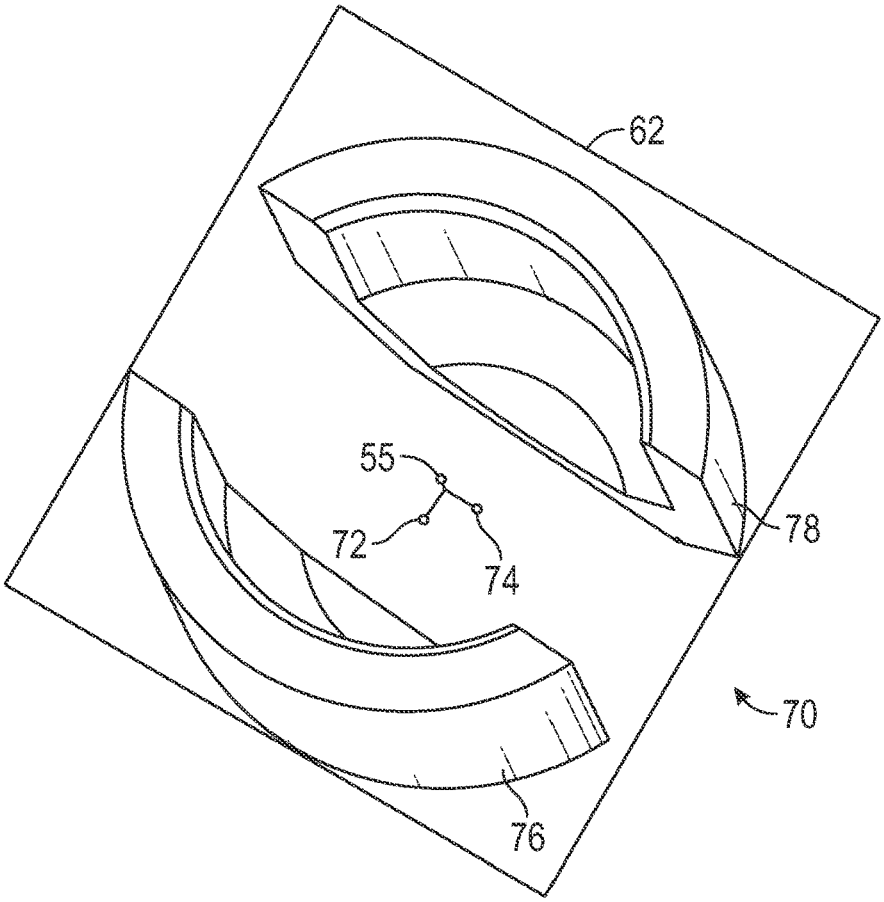
FIG. 7A shows a perspective view of an embodiment of a first example of a planar symmetric confinement structure that imparts a planar symmetry to a shaped charge, in accordance with aspects of the present disclosure.
Figure 7B:
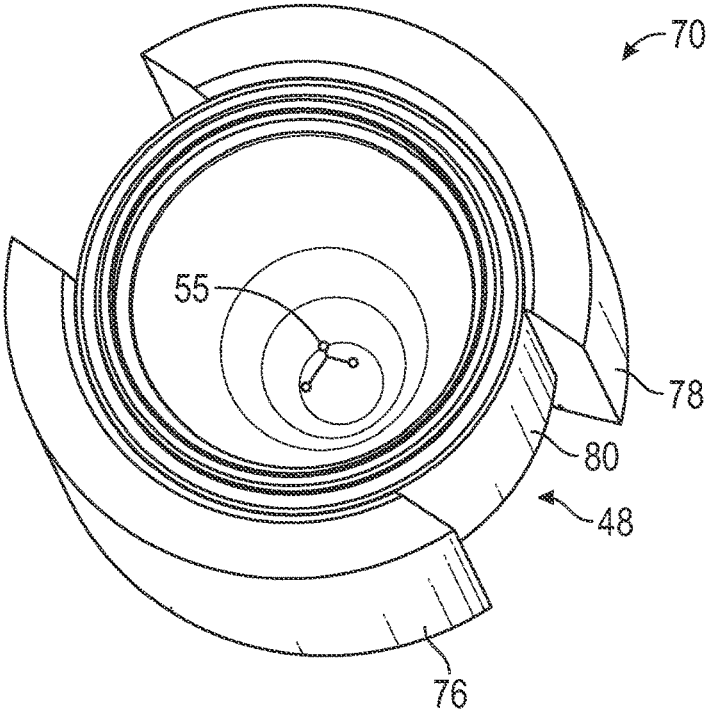
FIG. 7B shows a perspective view of an embodiment of a shaped charge that includes the planar symmetric confinement of FIG. 7A, in accordance with aspects of the present disclosure.

FIGS. 7A and 7B show a planar symmetric confinement feature 70 (e.g., external confinement feature) that may be provided around the liner member 48 or planar symmetry charge liner 50. To facilitate discussion of the planar symmetric confinement feature 70, FIGS. 7A and 7B include axis 55, axis 72, and axis 74. Axis 55 generally corresponds to the direction that a jet 28 is produced, and axis 72 and axis 74 are lateral axes. In general, the planar symmetric confinement feature 70 imparts a planar symmetry to the liner member 48 or planar symmetry charge liner 50 along the axis 55. The planar symmetric confinement feature 70 has a plane 62 of symmetry that spans the axis 72 and the axis 74 along most of the axial length of the planar symmetric confinement feature 70 (e.g., along the axis 55). In some embodiments, the planar symmetric confinement feature 70 may be used in conjunction with planar symmetry charge liner 50.

In the illustrated embodiment, the planar symmetric confinement feature 70 includes two separable components, such as a first confinement portion 76 and a second confinement portion 78. As shown in FIG. 7B, the first confinement portion 76 and the second confinement portion 78 each couple to the outer surface 80 of the liner member 48. As shown, the first confinement portion 76 and the second confinement portion 78 each are approximately the same size and are symmetrical about a plane that spans the axis 55 and the axis 74. Such symmetry may cause the shaped charge to produce the fan-like cutting jet (e.g., a perforating jet 28, that would extend along the axis 55) as the explosive component 46 collapses inwards towards the interior volume 44.

Figure 8B:
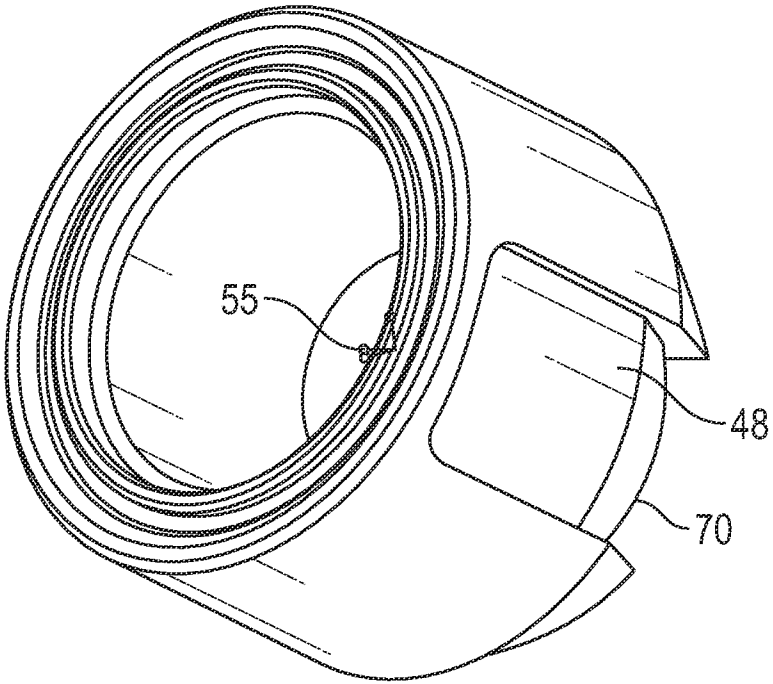
FIG. 8B shows a perspective view of an embodiment of a shaped charge that includes the planar symmetric confinement of FIG. 8A, in accordance with aspects of the present disclosure.
Figure 8A:
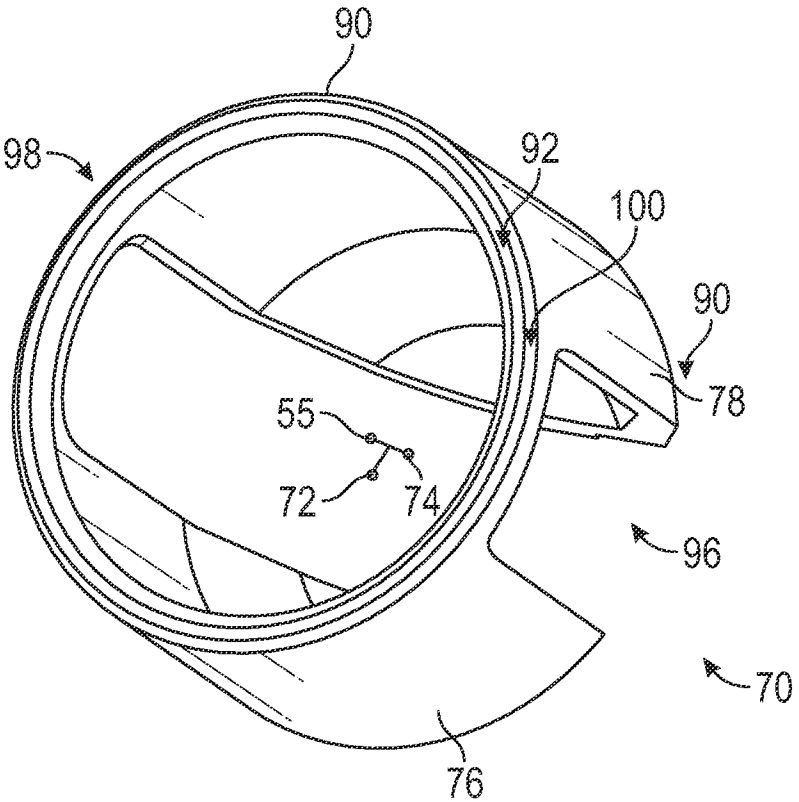
FIG. 8A shows a perspective view of an embodiment of a first example of a planar symmetric confinement structure that imparts a planar symmetry to a shaped charge, in accordance with aspects of the present disclosure.

In some embodiments, the planar symmetric confinement feature 70 may be provided as a single component. To illustrate this, FIGS. 8A and 8B show a planar symmetric confinement feature 70 that may be provided around the liner member 48 or planar symmetry charge liner 50. To facilitate discussion of the planar symmetric confinement feature 70, FIGS. 8A and 8B include axis 55, axis 72, and axis 74. Axis 55 generally corresponds to the direction that a jet 28 is produced, and axis 72 and axis 74 are lateral axes. In a generally similar manner as described in FIG. 7A and 7B, the planar symmetric confinement feature 70 imparts a planar symmetry to the liner member 48 along the axis 55. Further, the planar symmetric confinement feature 70 has a plane 62 of symmetry that spans the axis 72 and the axis 74.

As shown in the illustrated embodiment, the planar symmetric confinement feature 70 includes a coupling rim 90 on a first axial end 92 (e.g., along the axis 55) of the planar symmetric confinement feature 70 that joins a first confinement portion 76 and a second confinement portion 78 (e.g., which may be disposed on opposite radial sides of the planar symmetric confinement feature 70). Additionally or alternatively, the planar symmetric confinement feature 70 may include a coupling rim 90 on the second axial end 94 (e.g., along the axis 55) of the planar symmetric confinement portion 70. As shown, the coupling rim 90 is a circular portion of the planar symmetric confinement portion 70. However, the coupling rim 90 may be any suitable shape, such as a rectangular shape, a hexagonal shape, an octagonal shape, and so on. In general, the first axial end 92 corresponds to an outer axial end of the shaped charge 20 that is downstream of the direction of travel of the perforating jet.

In any case, the planar symmetric confinement feature 70 includes a window 96 that generally runs between the first confinement portion 76 and the second confinement portion 78. The window 96 also runs along the axis 74 of the planar symmetric confinement portion 70 from a first lateral end 98 to a second lateral end 100. In some embodiments, the planar symmetric confinement feature 70 may be capable of surrounding the shaped charge 20. For example, the planar symmetric confinement portion 70 could serve as a charge jacket or it could be designed to fit an existing charge jacket (e.g., relatively larger than an additional charge jacket).

Figure 9B:
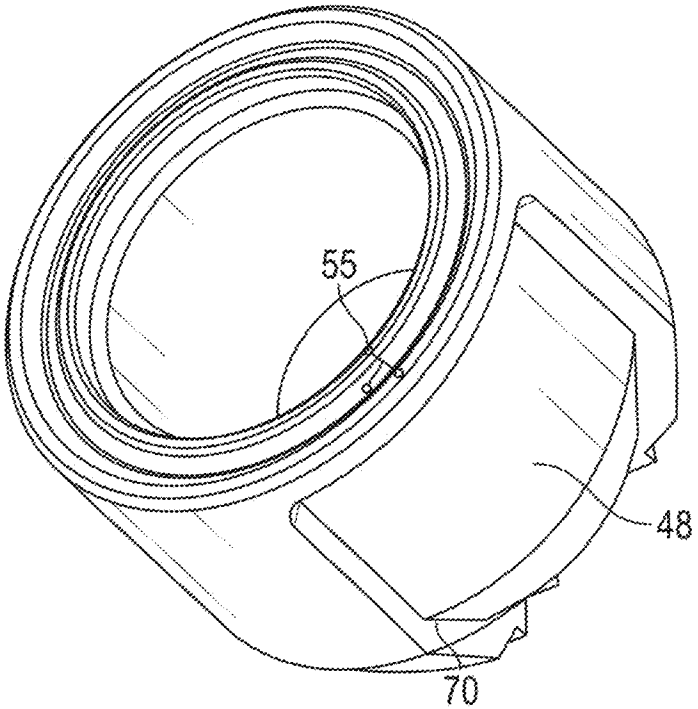
FIG. 9B shows a perspective view of an embodiment of a shaped charge that includes the planar symmetric confinement of FIG. 9A, in accordance with aspects of the present disclosure.
Figure 9A:
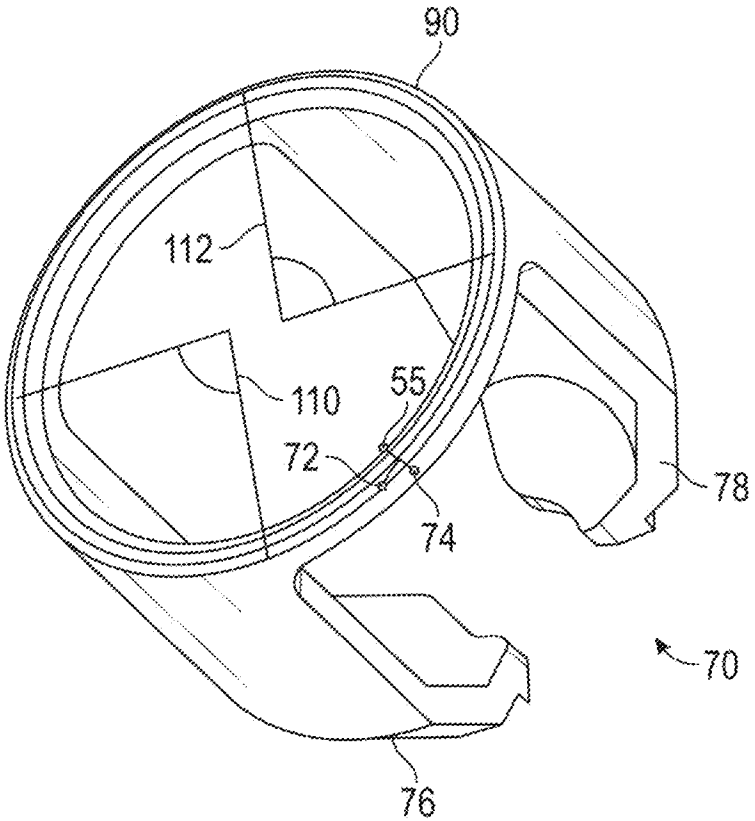
FIG. 9A shows a perspective view of an embodiment of a first example of a planar symmetric confinement structure that imparts a planar symmetry to a shaped charge, in accordance with aspects of the present disclosure.

As shown in FIGS. 8A and 8B, the window 96 is generally a linear or straight divide between the first confinement feature 76 and the second confinement feature 78. Accordingly, the first confinement feature 76 and the second confinement feature 78 have a hemispherical shape. In some embodiments, the window 96 (e.g., a split in the mass of the planar symmetric confinement feature 70) is not linear, such that the first confinement feature 76 and the second confinement feature 78 have a pie-slice shape. To illustrate this, FIGS. 9A and 9B show a planar symmetric confinement feature 70 that may be provided around the liner member 48. To facilitate discussion of the planar symmetric confinement feature 70, FIGS. 9A and 9B include axis 55, axis 72, and axis 74. Axis 55 generally corresponds to the direction that a jet 28 is produced, and axis 72 and axis 74 are lateral axes. In a generally similar manner as described in FIG. 7A and 7B, the planar symmetric confinement feature 70 imparts a planar symmetry to the liner member 48 along the axis 55.

As shown, the first confinement feature 76 and the second confinement feature 78 each generally extend along circular portions 110, 112, respectively, of the circular coupling rim 90. The circular portions 110, 112, may be 120 degrees or less, 100 degrees or less, 90 degrees or less, 80 degrees or less, and so on. As shown, the circular portions 110, 112 are substantially similar. However, in some embodiments, the circular portions 110, 112 may be different.

Figure 10B:
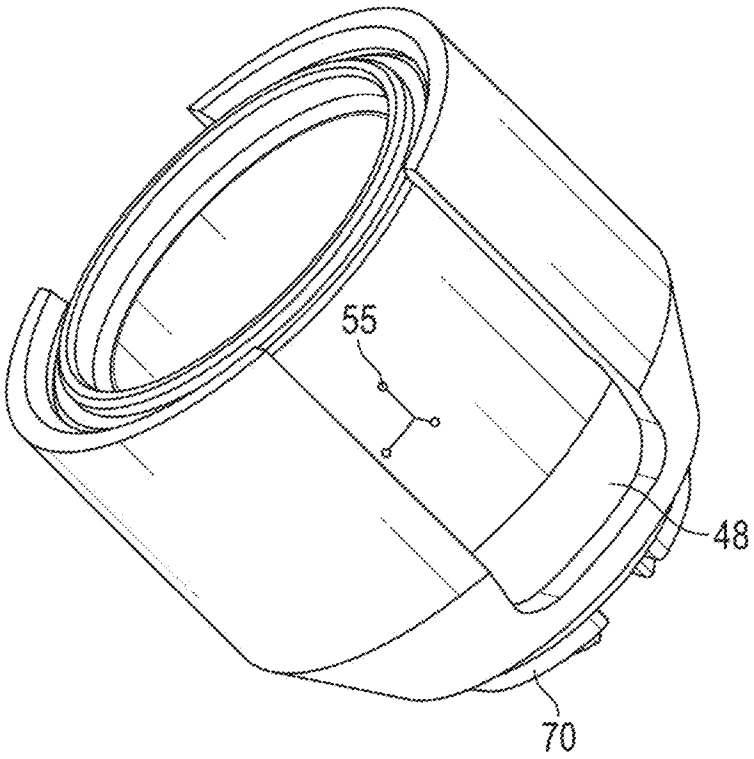
FIG. 10B shows a perspective view of an embodiment of a shaped charge that includes the planar symmetric confinement of FIG. 10A, in accordance with aspects of the present disclosure.
Figure 10A:
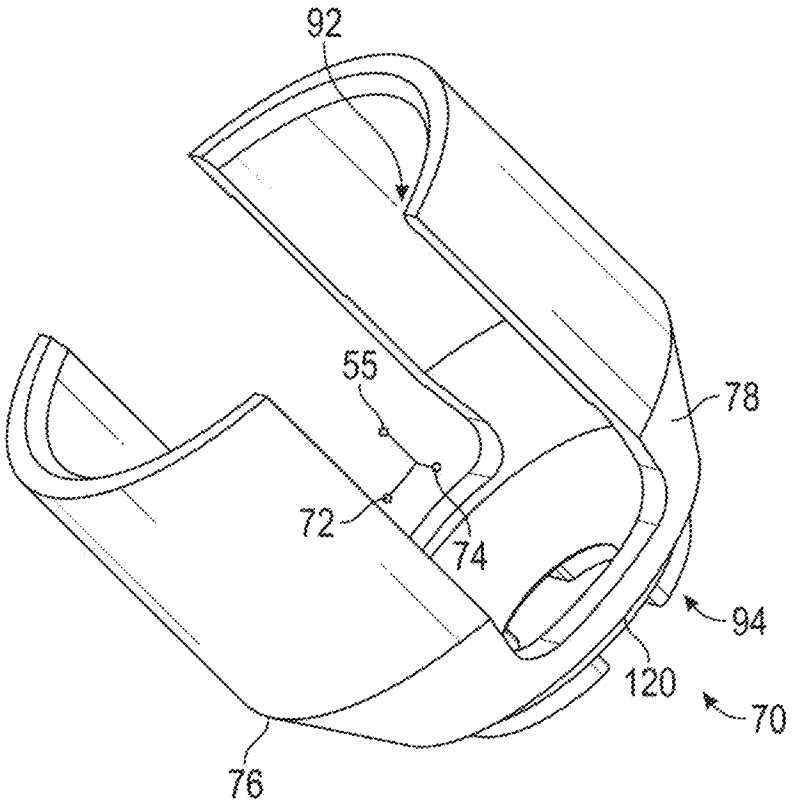
FIG. 10A shows a perspective view of an embodiment of a first example of a planar symmetric confinement structure that imparts a planar symmetry to a shaped charge, in accordance with aspects of the present disclosure.

As mentioned above, with respect to FIGS. 8A, and 8B, the first confinement feature 76 and the second confinement feature 78 may be coupled on either the first axial end 92 or the second axial end 94 of the planar symmetric confinement feature 70. FIGS. 10A and 10B show a planar symmetric confinement feature 70 that may be provided around the liner member 48. To facilitate discussion of the planar symmetric confinement feature 70, FIGS. 10A and 10B include axis 55, axis 72, and axis 74. Axis 55 generally corresponds to the direction that a jet 28 is produced, and axis 72 and axis 74 are lateral axes. In a generally similar manner as described in FIG. 10A and 10B, the planar symmetric confinement feature 70 imparts a planar symmetry to the liner member 48 along the axis 55.

As shown, the first confinement feature 76 is coupled to the second confinement feature 78 at the second axial end 94 of the planar symmetric confinement feature 70. For example, the planar symmetric confinement feature 70 includes a coupling rim 120. The coupling rim 120 is generally a conical shape with a diameter that decreases along the axis 72 and the axis 74 as the coupling rim 120 extends along the axis 55 in a direction towards the second axial end 94. For example, the coupling rim 120 may correspond to the second axial end 94 where the apex 56 resides.

Figure 11B:
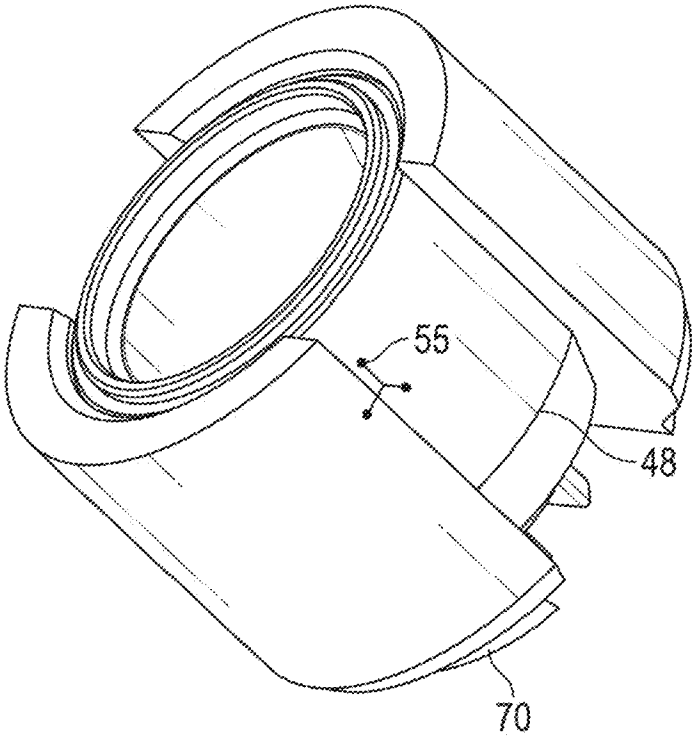
FIG. 11B shows a perspective view of an embodiment of a shaped charge that includes the planar symmetric confinement of FIG. 11A, in accordance with aspects of the present disclosure.
Figure 11A:
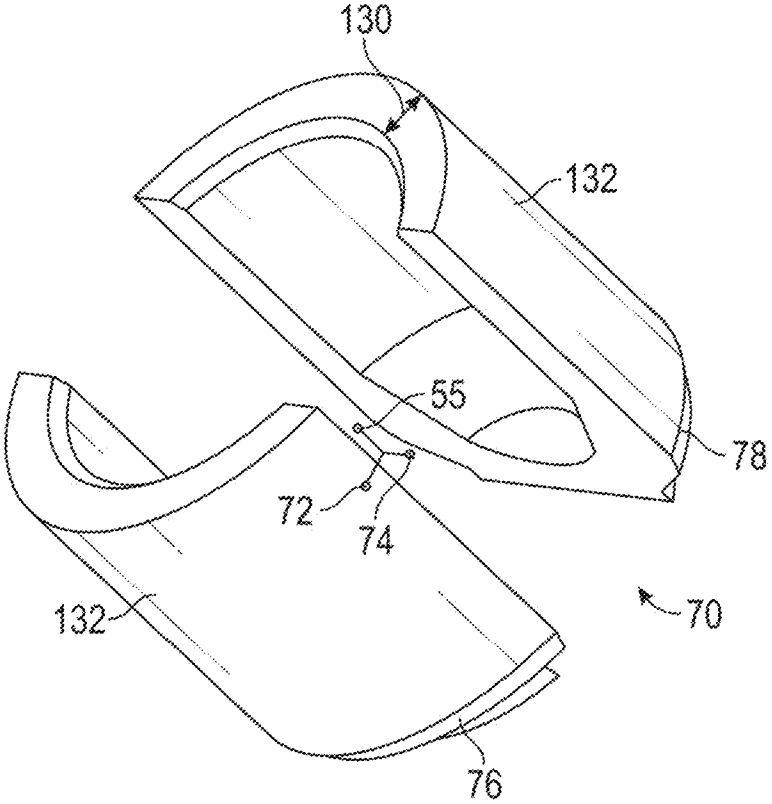
FIG. 11A shows a perspective view of an embodiment of a first example of a planar symmetric confinement structure that imparts a planar symmetry to a shaped charge, in accordance with aspects of the present disclosure.

It is presently recognized that the higher the density of the material being used and the thicker the tamping mass, the more effective it will be at fanning the jet 28. To illustrate this, FIGS. 11A and 11B show a planar symmetric confinement feature 70 that may be provided around the liner member 48. To facilitate discussion of the planar symmetric confinement feature 70, FIGS. 11A and 11B include axis 55, axis 72, and axis 74. Axis 55 generally corresponds to the direction that a jet 28 is produced, and axis 72 and axis 74 are lateral axes. In a generally similar manner as described in FIG. 7A and 7B, the planar symmetric confinement feature 70 imparts a planar symmetry to the liner member 48 along the axis 55. In general, each of the examples show a planar symmetric confinement feature 70 that includes additional mass (e.g., due to the first confinement portion 76 and the second confinement portion 78) that are at poles 180 degrees apart (e.g., opposing axial sides). As shown, the thickness 130 of the walls 132 of the planar symmetric confinement feature 70 is generally thicker than what was generally shown in FIGS. 7-10. This is discussed in more detail below.

Figure 12A:
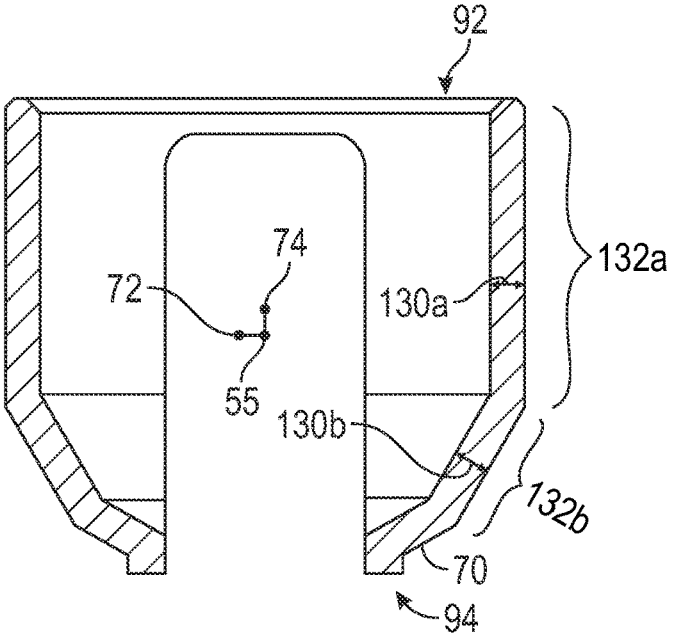
FIG. 12A shows a cross-sectional view of planar symmetry confinement structure having a first type of thickness, in accordance with aspects of the present disclosure.
Figure 12B:
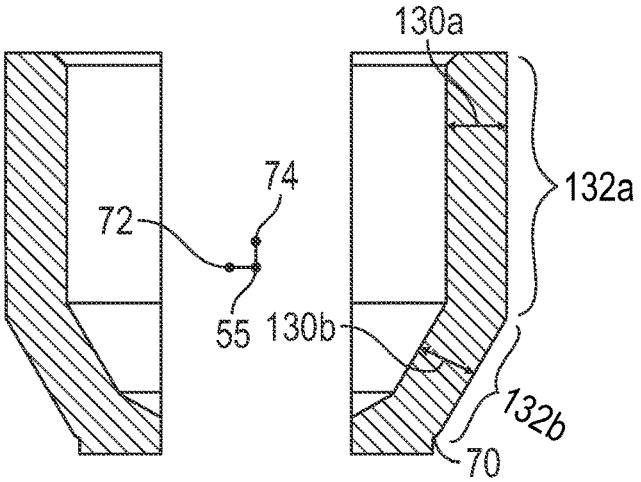
FIG. 12B shows a cross-sectional view of planar symmetry confinement structure having a second type of thickness, in accordance with aspects of the present disclosure.
Figure 12C:
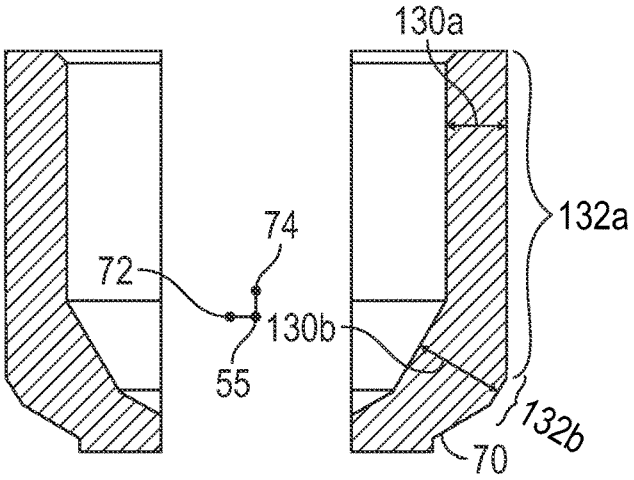
FIG. 12C shows a cross-sectional view of planar symmetry confinement structure having a third type of thickness, in accordance with aspects of the present disclosure.

In some embodiments, the planar symmetric confinement feature 70 may have a varying thickness from the base of the charge case to its top. To illustrate this, FIGS. 12A, 12B, and 12C (e.g., collectively FIGS. 12A-C) show examples of the planar symmetric confinement feature 70 having varying thicknesses. To facilitate discussion of the planar symmetric confinement feature 70, FIGS. 12A, 12B, and 12C include axis 55, axis 72, and axis 74. FIG. 12A shows a uniformly thick version from the first axial end 92 to the second axial end 94. That is, a wall 132*a* has a first thickness 130*a*, and a wall 132*b* has a second thickness 130*b* that is equal to the first thickness 130*a*. FIG. 12B shows a thicker uniformly thick version from the first axial end 92 to the second axial end 94. That is, the wall 132*a* has a first thickness 130*a*, and the wall 132*b* has a second thickness 130*b* that is equal to the first thickness 130*a*. Further, the thicknesses 130*a* and 130*b* show in FIG. 12B are greater than the thicknesses 130 shown in FIG. 12A. FIG. 12C shows a non-uniformly thick version from the first axial end 92 to the second axial end 94. That is, the wall 132*a* has a first thickness 130*a*, and the wall 132*b* has a second thickness 130*b* that is different than the first thickness 130*a*. In FIG. 12C, the first thickness 130*a* is less than the second thickness 130*b*. However, in some embodiments, the first thickness 130*a* may be greater than the second thickness 130*b*. It should be noted that the techniques for variable thickness may also be applied to the liner member 48 and the explosive component 46 arrangement described in FIG. 6.

Figure 13:
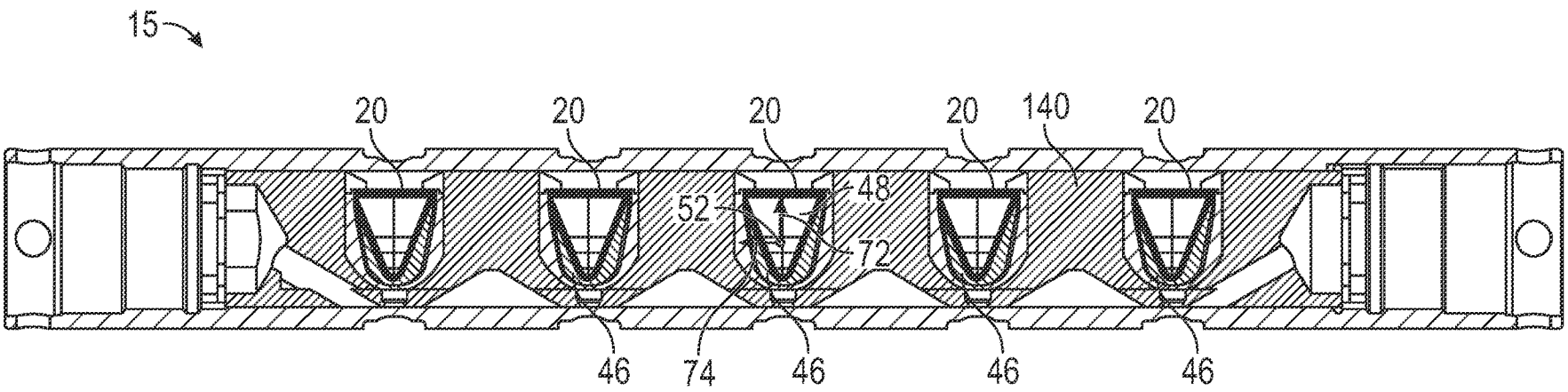
FIG. 13 shows a cross-sectional view of a perforating gun that includes a planar symmetry confinement structure, in accordance with aspects of the present disclosure.

In some embodiments, multiple tamping masses could be integrated into a single body and also serve other functions such as taking the place of the loading tube. To illustrate this, FIG. 13 shows a cross sectional view of a perforating gun 15 that includes a planar symmetric confinement feature 140 that houses multiple shaped charges 20. To facilitate discussion of the planar symmetric confinement feature 140, FIG. 13 include the axis 55, the axis 72, and the axis 74. In a generally similar manner as described above, the planar symmetric confinement feature 140 may impart a planar symmetry to the shaped charges 20, thereby resulting in a "fan-like cutting jet" upon ignition of the explosive component 46. In the illustrated embodiment, the planar symmetric confinement feature 140 holds the explosive component 46 and the liner member 48 of five shaped charges 20. However, in other embodiments, the planar symmetric confinement feature 140 may be sized to fit any number of shaped charges 20, such as two, three, four, five, or more than five.

Figure 14:
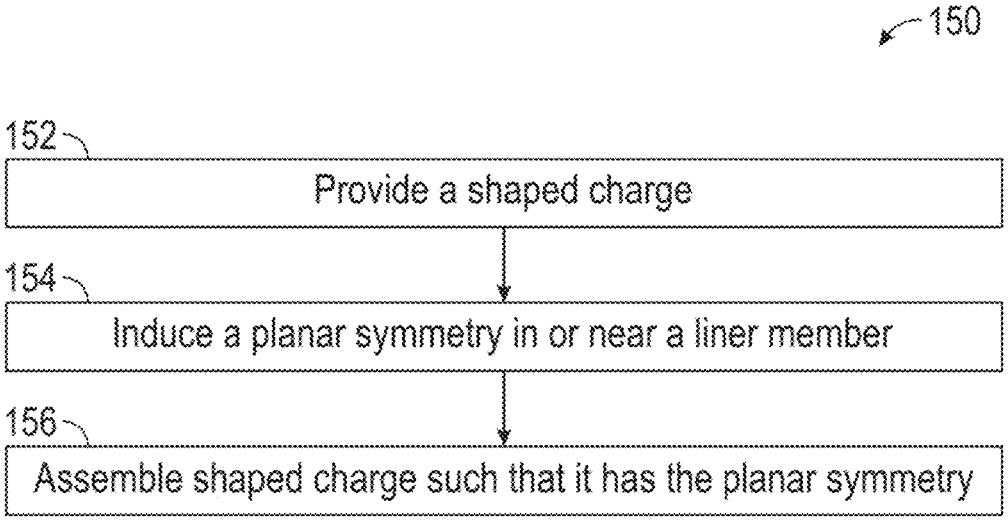
FIG. 14 shows a flow diagram of a method for assembling a shaped charge that includes a planar symmetry charge liner, in accordance with aspects of the present disclosure.

In any case, as described herein, the disclosed techniques for forming the planar symmetric confinement feature 70 or 140 may provide a shaped charge capable of producing a fan-like cutting jet that advantageously may cut certain downhole components, while preventing damage to the components that would otherwise result from other perforating jets. FIG. 14 shows an example process 150 for forming the planar symmetric confinement feature 70 or 140 in accordance with the present disclosure. As shown, the process 150 includes, at block 152, providing the shaped charge 20. Further, the process 150 includes inducing, at block 154, a planar symmetry on or near the liner member 48. In some embodiments, inducing the planar symmetry may include altering the mass distribution of the liner member 48 and/or the explosive component 46 such that the shaped charge 20 includes a region having a planar symmetry. That is, as opposed to an axial symmetry, a portion may have a type of planar symmetry such that the object has a horizontal mirror plane. In some embodiments, inducing the planar symmetry may include coupling a planar symmetric confinement feature 70 to the shared charge 20. For example, the planar symmetric confinement feature 70 may be coupled to the outer surface of the liner member 48 and/or the explosive component 46. In some embodiments, the planar symmetric confinement feature 70 may be coupled to an exterior of the shaped charge 20, as generally shown in FIG. 13. In some embodiments, the planar symmetric confinement feature 70 may be formed of relatively dense, easy to machine (e.g., malleable) materials, such as lead, brass, zinc, and the like. It is presently recognized that it may be advantageous such that the material forming the planar symmetric confinement feature 70 has close to the same shock impedance as the casing 42, such as steel or zinc.

Further, the planar symmetric confinement feature 70 may be multilayered, which may be capable of dissipating reflections. Further, drop-in parts may be used that may include combinations of metals and/or certain plastics, such as injection molded plastics. Referring back to the process 150, at block 156, the process includes assembling the shaped charge 20 such that the shaped charge 20 includes a region having a planar symmetry. In some embodiments, the process includes assembling a perforating gun 15 using the shaped charge.

Accordingly, the present disclosure relates to a planar symmetric confinement feature 70 or 140 that causes a perforating jet emitted by a shaped charge 20 to have a fan-like cutting jet. The disclosed techniques may be retrofitted onto existing perforating guns 15, without needing to manufacture a different type of explosive component 46 and/or liner member 48.

While only certain features of the invention have been illustrated and described herein, many modifications and changes will occur to those skilled in the art. It is, therefore, to be understood that the appended claims are intended to cover all such modifications and changes as fall within the true spirit of the invention.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A shaped charge, comprising:

a casing;

an explosive component disposed inside of the casing; and a liner member disposed inside of the explosive component, wherein the explosive component and the liner member are configured to emit a perforating jet based on ignition of the explosive component, wherein the liner member has a planar symmetric portion that is planar symmetric along an axial length of the planar symmetric portion relative to planes perpendicular to a direction of the emitted perforating jet, wherein the planar symmetric portion comprises first and second confinement portions disposed at opposing sides of the liner member about a longitudinal axis of the shaped charge, wherein the first and second confinement portions extend along the axial length, and the axial length is at least half of a total axial length of an interior volume of the liner member.

2. The shaped charge of claim 1, wherein the first and second confinement portions extend from an upstream portion to a downstream portion of the shaped charge, the upstream portion comprises an apex of the liner member, and the downstream portion comprises an outlet of the interior volume.

3. The shaped charge of claim 1, wherein the first and second confinement portions comprise an additional mass in the liner member at the opposing sides of the liner member.

4. The shaped charge of claim 1, wherein the liner member has an axial symmetric portion that is axial symmetric relative to the direction of the emitted perforating jet, the axial symmetric portion is an upstream portion of the shaped charge comprising a skirt portion expanding outwardly from an apex portion in the direction of the emitted perforating jet, and the planar symmetric portion is a downstream portion of the shaped charge.

5. The shaped charge of claim 1, wherein the first and second confinement portions are disposed inside of the explosive component and are coupled to an outer surface of the liner member, the first and second confinement portions are circumferentially split at a window, and an inner surface of the liner member extends around the interior volume along the longitudinal axis of the shaped charge.

6. The shaped charge of claim 5, wherein the first and second confinement portions are coupled together via a coupling rim across the window.

7. The shaped charge of claim 6, wherein the coupling rim is an annular rim extending circumferentially about the longitudinal axis, the window includes first and second window portions diametrically opposite to one another about the longitudinal axis, the first window portion extends axially along the longitudinal axis from the annular rim at a first circumferential split between the first and second confinement portions, and the second window portion extends axially along the longitudinal axis from the annular rim at a second circumferential split between the first and second confinement portions.

8. A shaped charge, comprising:

a casing;

an explosive component disposed inside of the casing;

a liner member disposed inside of the explosive component, wherein the explosive component and the liner member are configured to emit a perforating jet based on ignition of the explosive component; and an external confinement feature disposed inside of the explosive component about the liner member, wherein the external confinement feature is configured to impart a planar symmetry to the shaped charge, the external confinement feature comprises first and second confinement portions disposed at opposing sides of the liner member about a longitudinal axis of the shaped charge, the first and second confinement portions are circumferentially split at a window, and the external confinement feature comprises a coupling rim extending across the window and coupling together the first and second confinement portions.

9. The shaped charge of claim 8, wherein the first and second confinement portions are coupled to an outer surface of the liner member, and an inner surface of the liner member extends around an interior volume along the longitudinal axis of the shaped charge.

10. The shaped charge of claim 9, wherein the explosive component extends between the casing and the external confinement feature, and the explosive component extends through the window and couples to the outer surface of the liner member.

11. The shaped charge of claim 8, wherein the coupling rim is disposed on a downstream portion of the shaped charge relative to a direction of travel of the perforating jet.

12. The shaped charge of claim 8, wherein the coupling rim is disposed on an upstream portion of the shaped charge relative to a direction of travel of the perforating jet.

13. The shaped charge of claim 8, wherein the coupling rim comprises a conical shape.

14. The shaped charge of claim 8, wherein the external confinement feature comprises a variable thickness along an axial length of the external confinement feature.

15. The shaped charge of claim 8, wherein the coupling rim is an annular rim extending circumferentially about the longitudinal axis, the window includes first and second window portions diametrically opposite to one another about the longitudinal axis, the first window portion extends axially along the longitudinal axis from the annular rim at a first circumferential split between the first and second confinement portions, and the second window portion extends axially along the longitudinal axis from the annular rim at a second circumferential split between the first and second confinement portions.

16. A method, comprising:

providing a shaped charge having a casing, an explosive component, and a liner member;

inducing a planar symmetry in or adjacent the liner member via a planar symmetric portion, wherein the planar symmetric portion comprises first and second confinement portions disposed at opposing sides of the liner member about a longitudinal axis of the shaped charge, the first and second confinement portions extend along an axial length of the planar symmetric portion, the axial length is at least half of a total axial length of an interior volume of the liner member, the first and second confinement portions are separated from one another at first and second circumferential splits being diametrically opposite to one another about the longitudinal axis, and the planar symmetric portion comprises a coupling portion extending across the first and second circumferential splits and coupling together the first and second confinement portions; and assembling the shaped charge having the casing, the explosive component disposed inside of the casing, and the liner member with the planar symmetric portion disposed inside of the explosive component.

17. The method of claim 16, wherein inducing the planar symmetry comprises altering a mass distribution of the liner member such that the first and second confinement portions comprise an additional mass in the liner member at the opposing sides of the liner member, and the coupling portion is an integral part of the liner member extending between the first and second confinement portions.

18. The method of claim 16, wherein inducing the planar symmetry comprises providing an external confinement feature coupled to an outer surface of the liner member, the external confinement feature comprises the first and second confinement portions coupled together via the coupling portion, the first circumferential split is a first window portion of a window in the external confinement feature, and the second circumferential split is a second window portion of the window in the external confinement feature.

19. The method of claim 18, wherein the external confinement feature is formed of lead, brass, zinc, or a combination thereof.

20. The method of claim 18, wherein the coupling portion is an annular coupling rim at an upstream portion or a downstream portion of the shaped charge.

* * * * *